US005481347A

United States Patent [19]

Adachi et al.

[11] Patent Number: 5,481,347

[45] Date of Patent: Jan. 2, 1996

[54] REMOVABLE ROLLERS IN AN IMAGE FIXING DEVICE

[75] Inventors: Nobukazu Adachi, Tokyo; Yutaka Kikuchi, Kawasaki, both of Japan

[73] Assignee: Canon Kabushiki Kaisha, Tokyo, Japan

[21] Appl. No.: 447,836

[22] Filed: May 23, 1995

Related U.S. Application Data

[63] Continuation of Ser. No. 92,939, Jul. 19, 1993, abandoned, which is a continuation of Ser. No. 899,127, Jun. 18, 1992, abandoned, which is a continuation of Ser. No. 583,244, Sep. 17, 1990, abandoned.

[30] Foreign Application Priority Data

Sep. 16, 1989 [JP] Japan ..... 1-238392

[51] Int. Cl.[6] ..... G03G 15/20

[52] U.S. Cl. ..... 355/285; 355/289; 355/206; 219/216

[58] Field of Search ..... 219/216, 469, 219/470; 355/282, 285, 289, 299, 295, 206, 208

[56] References Cited

U.S. PATENT DOCUMENTS

| | | | |
|---|---|---|---|
| 4,147,501 | 4/1979 | Goshima et al. | 219/469 X |
| 4,389,114 | 6/1983 | Westerman | 219/216 |
| 4,428,660 | 1/1984 | Matsumoto | 219/216 |
| 4,640,600 | 2/1987 | Hirabayashi et al. | 219/216 X |
| 4,785,319 | 11/1988 | Fujino et al. | 346/160 |
| 4,899,197 | 2/1990 | Davis et al. | 355/290 |

FOREIGN PATENT DOCUMENTS

| | | |
|---|---|---|
| 0000631 | 2/1979 | European Pat. Off. . |
| 0213745 | 3/1987 | European Pat. Off. . |
| 0251693 | 1/1988 | European Pat. Off. . |
| 0342367 | 11/1989 | European Pat. Off. . |
| 313119522 | 2/1982 | Germany . |
| 3832415 | 4/1989 | Germany . |
| 57-155570 | 9/1982 | Japan . |
| 114264 | 5/1986 | Japan . |
| 2108430 | 5/1983 | United Kingdom . |

OTHER PUBLICATIONS

"IBM Technical Disclosure Bulletin" vol. 22, No. 10, Mar. 1980, p. 4403.

"IBM Technical Disclosure Bulletin" vol. 23, No. 12, May 1981, pp. 5622–5623.

*Primary Examiner*—Benjamin R. Fuller

*Assistant Examiner*—John E. Barlow, Jr.

*Attorney, Agent, or Firm*—Fitzpatrick, Cella, Harper & Scinto

[57] ABSTRACT

An image fixing device includes a fixing roller having bearings at each end, a backup roller held in pressure contact with the fixing roller, and a frame receiving the fixing roller and backup roller and having an abnormal temperature rise prevention element. The fixing roller and the backup roller are insertable into the frame in directions perpendicular to the axes of these rollers. The bearing at one end of the fixing roller holds its entire circumference while the other bearing supports only part of the circumference of the fixing roller and the abnormal temperature rise prevention element is set at a predetermined positional relationship to the heating roller as a result of insertion of the heating roller.

32 Claims, 5 Drawing Sheets

REMOVABLE ROLLERS IN AN IMAGE FIXING DEVICE

This application is a continuation of application Ser. No. 08/092,939, filed on Jul. 19, 1993, now abandoned, which is a continuation of application Ser. No. 07/899,127, filed Jun. 18, 1992, now abandoned, which is a continuation of application Ser. No. 07/583,244, filed Sep. 17, 1990, now abandoned.

BACKGROUND OF THE INVENTION

1. Field of the Invention

The present invention relates to an image fixing device for use in an image forming apparatus such as a copying machine, a printer and the like. More specifically, the present invent:ion relates to a roller-type fixing device in which an image carried by a recording member is fixed to the recording member as the recording member is clamped between and conveyed by a pair of rollers.

2. Description of the Related Art

Hitherto, various image fixing methods for image forming apparatus have been proposed. Among these proposed methods, a roller-type fixing method, more particularly a heat roller type fixing method, has been used widely in which an image is fixed to an image carrying recording member as the recording member is made to pass through a nip between a heating roller backup roller.

FIG. 9 is a longitudinal sectional view of a known image fixing device of the heat roller type, while FIG. 10 is a side elevational view of the fixing device. The fixing device has a frame 1 which is composed of left and right side panels 1*a* and 1*b* and upper and lower stays 1*c* and 1*d* connected between side panels 1*a* and 1*b*. The frame 1 rotatably supports and accommodates the fixing roller 2 and the pressing roller 4.

This fixing device is assembled by assembling the frame 1 and then mounting the fixing roller 2 and the pressing roller 4 or, alternatively, by assembling the frame 1 while simultaneously mounting the fixing roller 2 and the pressing roller 4. In both cases, it is necessary to move the fixing roller 2 and the pressing roller 4 into the frame or half-finished frame from lateral sides of tile side panels 1*a* and 1*b*. This undesirably impairs production efficiency.

In addition, special assembly jigs are required for assembling the left and right side panels 1*a* and 1*b* and upper and lower stays 1*c* and 1*d* at high dimensional precision.

SUMMARY OF THE INVENTION

Accordingly, an object of the present invention is to provide an image fixing device which is easily assembled without requiring a special jig.

Another object of the present invention is to provide an image fixing device which can be assembled by moving a fixing roller into a frame in a direction perpendicular to the axis of the fixing roller.

Still another object of the present invention is to provide an image fixing device in which rollers are supported by partly-opened bearings.

To these ends, according to one aspect of the present invention, there is provided an image fixing device with a first roller and a second roller. The first and second rollers cooperate in nipping a recording member therebetween and thus conveying the recording member. A frame accommodates the first and second rollers, and a supporting member rotatable between a closed position and opened position where the first and second rollers are rotatable into the frame in directions perpendicular to the axes of the respective rollers.

In yet another aspect or the Applicant's invention, there is provided an image fixing device with a heating roller that contains a heat source and which is supported through bearings on a frame. Also included are abnormal temperature rise prevention means attached to the frame which will cut off the supply of electric power to the heat source in the event of an abnormal temperature rise of the heating roller. A supporting member which is rotatable between a closed and opened position is provided. While the supporting member is in the open position, the heating roller is insertable into the frame in a direction perpendicular to its axis and in such a way that the abnormal temperature rise prevention means is set at a predetermined positional relationship to the heating roller as a result of that insertion.

In another embodiment of Applicant's invention, there is provided a image fixing device where the fixing roller contains a drive gear on the end. That same end of the fixing roller is rotatably supported by a first bearing. A second bearing, also rotatably supporting the fixing roller, is provided at the other end of the fixing roller. Also included is a support member which is rotatable to an open position at which the fixing roller is insertable into the frame by movement in a direction perpendicular to the axis of the fixing roller. Once in position, the first bearing holds the entire circumference of the first end of the fixing roller but the second bearing supports only part of the circumference of the other end of the fixing roller.

In yet another aspect of the Applicant's invention, there is provided an image fixing device with a first roller and a second roller held in pressure contact with the first roller. A first frame supports the first roller through bearings while a second frame supports the second roller through bearings. The first and second rollers form a nip between which an image carrier passes. There is also provided means for allowing the first and second rollers to be set in the first and second frames, respectively, by being moved in directions perpendicular to the axis of the respective rollers.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
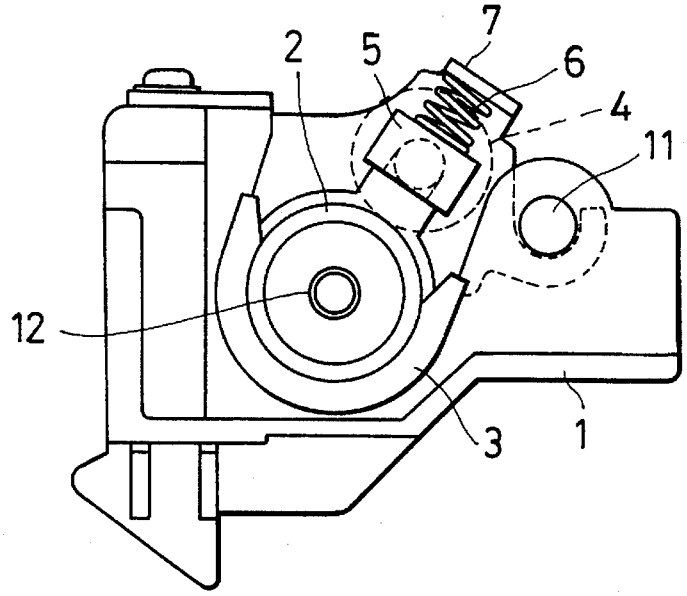
FIG. 1 is a side elevational view of an embodiment of the fixing device of the present invention as viewed from the side opposite to the driving side.

An image fixing device embodying the present invention will be described with reference to FIGS. 1 to 8.

Referring to these Figures, the image fixing device has a frame 1 which is integrally formed front a heat-resistant plastic material. The frame 1 rotatably carries a fixing roller 2 in which is disposed a halogen heater 12 for heating the fixing roller. The halogen heater 12 generates heat when supplied with electrical power from a power supply which is not shown.

A temperature sensing element (not shown) is held in contact with the surface of the fixing roller 2. The supply of the electrical power to the heater 12 is controlled in accordance with the output from the temperature sensing element so as to maintain the surface of the fixing roller at a predetermined temperature.

The frame 1 rotatably supports an idler shaft 11 which engages with a pressing plate 7. The pressing plate 7 is rotatable about the axis of the idler shaft 11, as will be seen from FIG. 7. A pressing roller 4 having a rubber layer is rotatably supported by the pressing plate 7.

The fixing roller 2 and the pressing roller 4 are supported by the following structures. As will be seen from FIG. 4, a bearing 8 and a gear 9 are beforehand mounted on the driving-side end of the fixing roller 2. The bearing 8 and the gear 9 are kept from coming off the fixing roller 2 by means of stopper rings 20 and 20. The other end of the fixing roller, i.e., the end opposite to the driving-side end, is supported by a partly-opened U-shaped bearing 3. The driving-side end of the fixing roller 2 is supported by be frame 1 through bearing 8 which is beforehand mounted on the fixing roller 2. As will be seen from FIGS. 5 and 6, the side panels of the frame 1 are provided with substantially U-shaped openings 1*a* and 1*b* which open in the upward direction. The bearings 3 and 8 supporting the respective ends of the fixing roller 2 are received in openings 1*a* and 1*b*.

The pressing roller 4 is supported at its both ends by bearings 5 and 5. As will be seen from FIG. 1, each bearing 5 is provided with a sliding surface only over half circumference thereof which receives the load of the pressing roller 4. The bearing 5 is supported on the pressing plate 7 through a compression spring 6.

Figure 2:
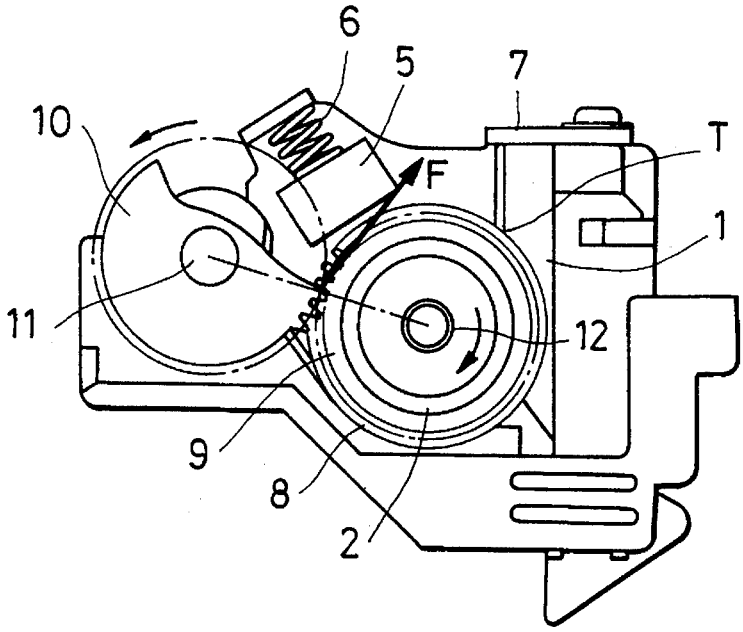
FIG. 2 is a side elevational view of the fixing device of FIG. 1 as viewed from he driving side.

A drive gear 10 meshing with the aforementioned gear 9 is supported by the idler shaft 11. When the drive gear is rotatingly driven by the driving power source which is not shown, the torque of the drive ear 10 is transmitted to the fixing roller 2 via the gear 9, so tat the fixing roller 2 and the pressing roller 4 contacting the fixing roller 2 are rotated. As shown in FIG. 2, a external force F acting on the fixing roller 2, generated due to a specific pressure angle of contact between the gears 9 and 10, is borne by a portion T of the frame, whereby any tendency for the fixing roller 2 to be lifted is suppressed.

The end of the fixing roller 2 opposite to the driving-side end is free from the external force produced by the contact between the gears 9 and 10. This end of the fixing roller 2 is therefore stably held in U-shaped bearing 8 as a result of the force produced by the pressing springs 6, 6.

Figure 3:
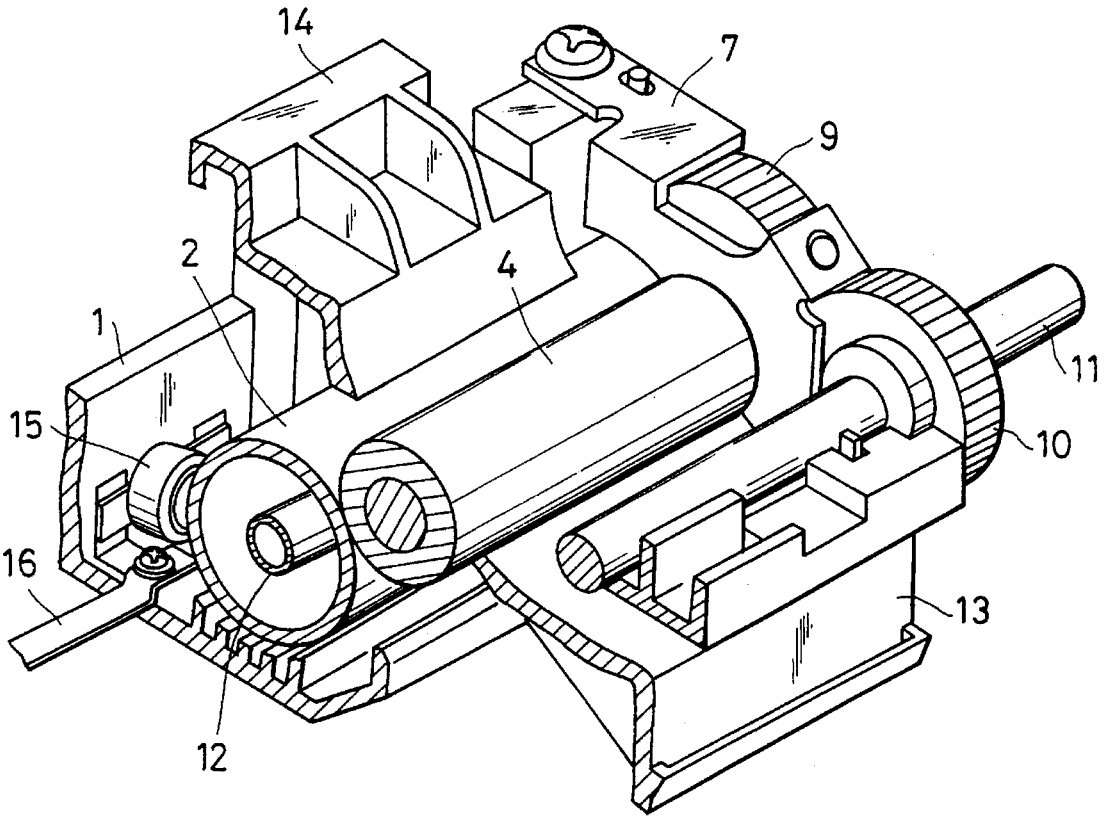
FIG. 3 is a perspective view of the fixing device.

As shown in FIG. 3, the frame 1 is provided with an inlet guide 13 and an ejection guide 14. The inlet guide 13 is arranged so as to guide the recording paper carrying an unfixed image to the nip between the fixing roller 2 and the pressing roller 4, such that the image carrying surface of the recording paper is brought into contact with the fixing roller 2. The ejecting guide 14 is adapted to guide the recording paper to a paper ejecting roller (not shown), after fixing of the image.

Namely, in operation a recording member such as a sheet of recording paper is guided by the inlet guide to the above-mentioned nip.

The recording member is made to pass through the nip between the fixing roller 2 and the pressing roller 4 which backs up the fixing roller 2. The image carried by the recording member is fixed to the recording member by heat and pressure applied by the fixing roller 2 and the pressing roller 4 during passage of the recording member through the nip.

The recording paper which has passed through the nip is guided by the ejection guide to the ejection roller and is then ejected by the traction of the ejection roller.

The frame 1 also is provided with a thermo-switch 15 for cutting off the supply of the electrical power to the halogen heater in the event of an abnormal rise of the temperature of the fixing roller 2, and the frame 1 is also provided with a phosphor bronze plate 16 which provides an electrical connection between the thermo-switch 15 and the halogen heater 12.

Figure 5:
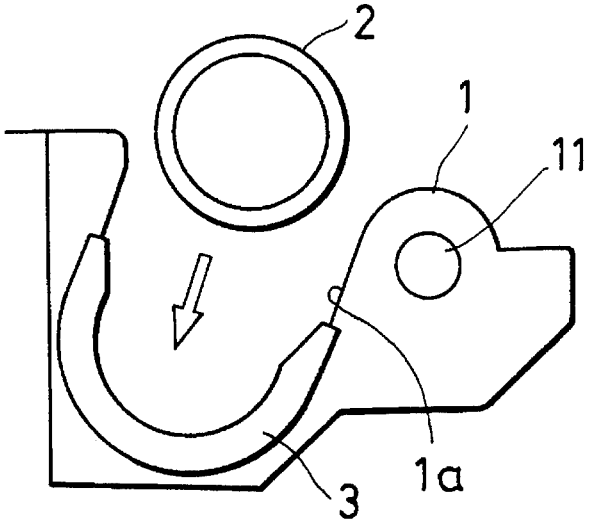
FIGS. 5 and 6 are side elevational views of the fixing device illustrating the manner in which a fixing roller is mounted in the fixing device during assembling of the fixing device.
Figure 6:
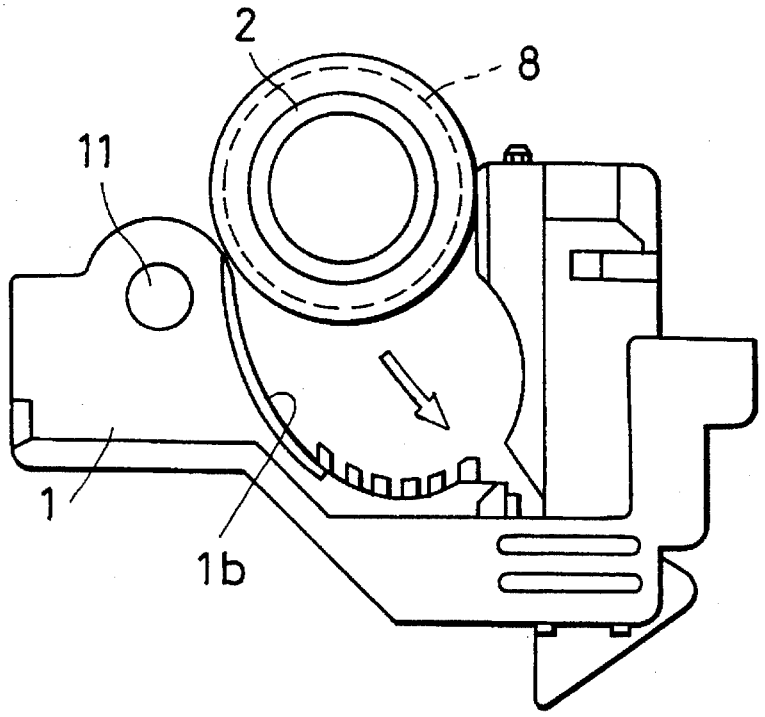
Figure 7:
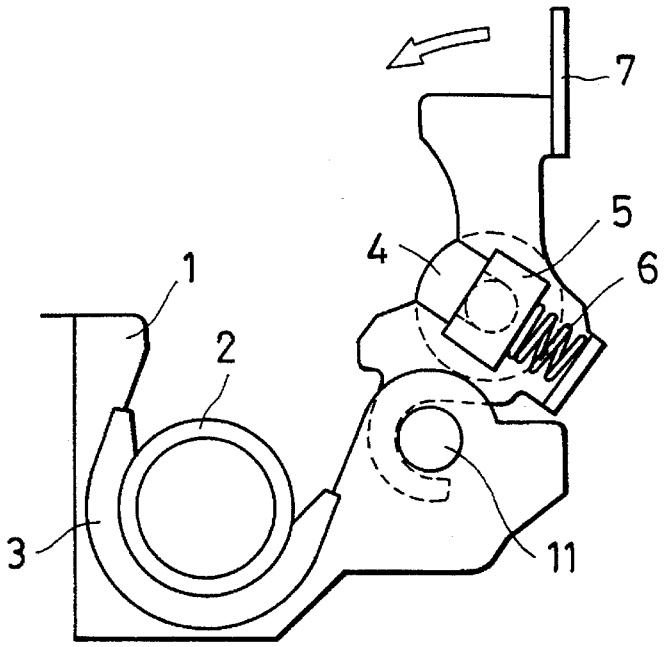
FIG. 7 is a side elevational view of the fixing device illustrating the manner in which a pressing roller is mounted in the fixing device during assembling of the fixing device.

A description will now be given of the proces for mounting the fixing roller 2 and the pressing roller 4, with specific reference to FIGS. 5 to 7.

Figure 4:
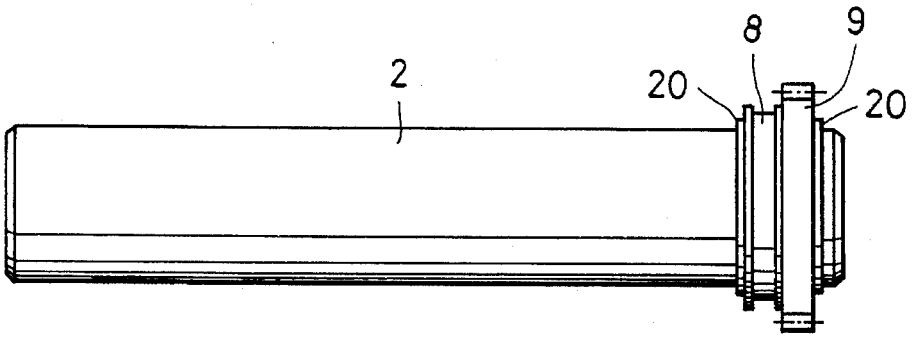
FIG. 4 is a plan view of a fixing roller.

As stated before, the fixing roller 2 is provided with the bearing 8 and the gear 9 on the driving-side end thereof, as shown in FIG. 4 before mounting. In order to mount this fixing roller 2, the fixing roller 2 is simply dropped into the openings 1*a* and 1*b* formed in the frame 1 perpendicularly to the axis of fixing roller 2, as indicated by the arrows in FIGS. 5 to 7. Consequently, both ends of the fixing roller 2 are rotatably supported by the frame 1 through the bearings 8 and 3.

In order to mount the pressing roller 4, the bearings 5, 5 and the pressing springs 6, 6 are first assembled together with the pressing plate 7. The pressing plate 7, with its hook portions retained on time idler shaft 11, is rotated clockwise around idler shaft 11, as viewed in FIG. 7 so as to open a passage for introducing the pressing roller 4. With the pressing plate 7 opened, the pressing roller 4 is moved into the bearings 5, 5 in a direction perpendicular to the axis of the idler shaft 11, whereby the pressing roller 4 is easily mounted in the frame. Then, pressing plate 7 is rotated counterclockwise as indicated by the arrow in FIG. 7 and is fixed to the frame 1 by means of a screw 7*a*. In this state, the pressing roller 4 is urged by the pressing springs 6 and 6 to resiliently contact the fixing roller 2.

After the completion of the assembly process described above, the inlet guide 13 and the ejection guide 14 are mounted on the frame 1. The thermo-switch 15 and the phosphor bronze plate 16 are mounted in the frame 1 before the mounting of the fixing roller 2.

Thus, the thermo-switch 15 can be arranged at a proper positional relation to the fixing roller 2 simply by mounting the fixing roller, so that time assembly process is remarkably simplified. In addition, since the fixing roller 2 is mounted by being moved in the direction which is orthogonal to the axis thereof, there is no risk for the surface of the fixing roller 2 to be damaged by the thermo-switch.

Furthermore, the resilient contact between the fixing roller 2 and the pressing roller 4 call easily be attained by fixing the pressing plate to the frame 1, thus contributing to a further facilitation of the assembly.

In this embodiment, a phosphor bronze plate 16 is attached to the frame 1 which provides a high degree of electrical insulation, so that lead wires and other conductive parts are eliminated to realize a compact wiring arrangement. This also contributes to simplification of the assembly process and, hence, to a reduction in the cost of production.

In the illustrated embodiment, mounting precisions for the components such as the fixing roller 2, pressing roller 4, inlet guide 13 and the ejection guide 14 are also enhanced by virtue of the fact that these components are mounted on the frame 1 which is integrally formed from a plastic.

The frame 1 may be formed from a sheet metal or from a combination of a sheet metal and a plastic sheet. Considering that the frame is preferably electrically insulating, it is preferred that the frame is integrally molded from a plastic.

Figure 8:
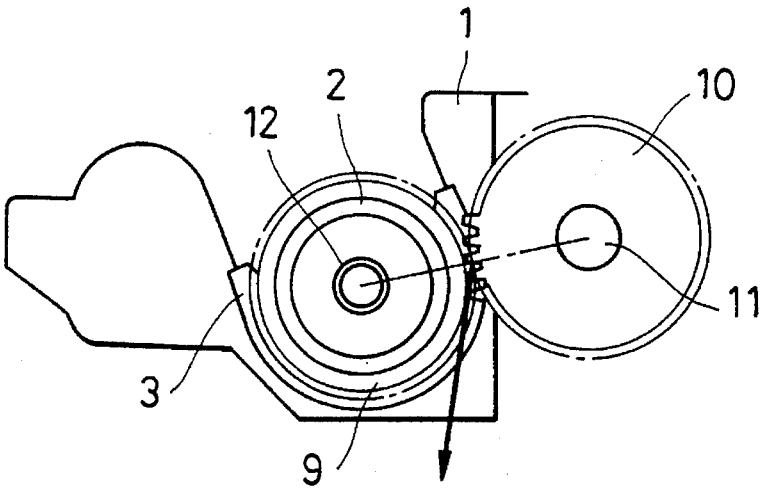
FIG. 8 is a side elevational view of another embodiment of the image fixing device of the present invention.
Figure 9:
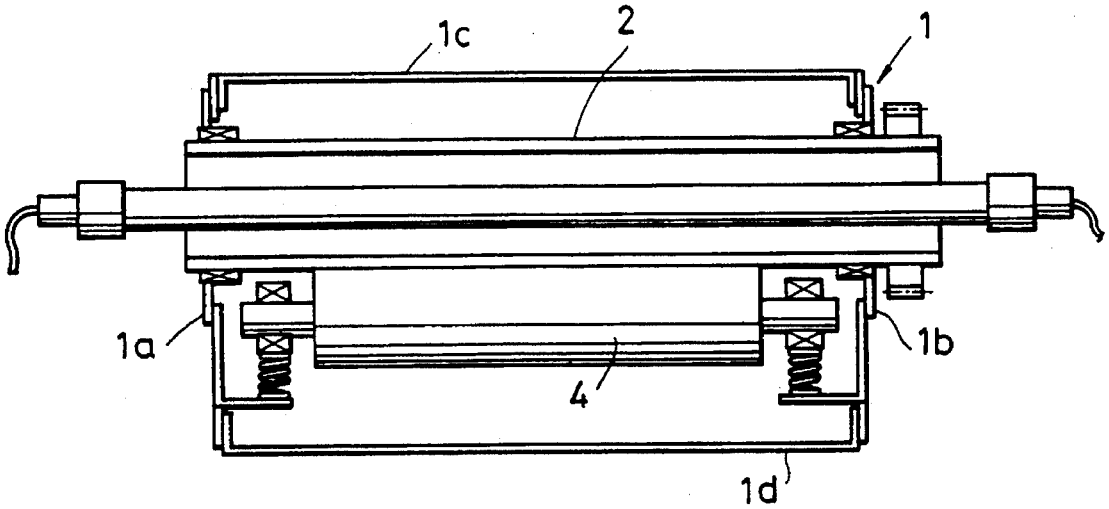
FIG. 9 PRIOR ART
FIG. 9 is a longitudinal sectional view of a known image fixing device.
Figure 10:
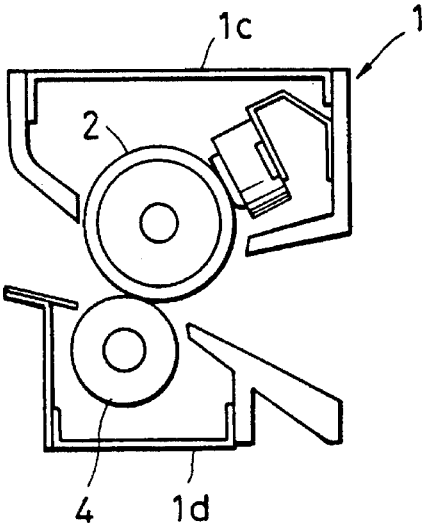
FIG. 10 PRIOR ART
FIG. 10 is a side elevational view of a fixing device shown in FIG. 9.

FIG. 8 shows another embodiment in which the direction of pressure angle of the contact between the gears 9 and 10 substantially coincides with the direction of the pressure exerted by the pressing roller 4. With this arrangement, it is possible to prevent the fixing roller 2 from being lifted even when U-shaped bearings are used for supporting both the driving-side end and the opposite end of the fixing roller 2.

The term "direction of pressure angle" is used in this specification to mean the direction of a line which intersects the common tangential line of bottom gears 9 and 10 at the same angle as the pressure angle to the comon tangential line.

Although the invention has been described through its preferred forms, it is to be noted that he described embodiments are only illustrative and various changes and modifications may be imparted thereto without departing from the scope of the invention which is limited solely by the appended claims.

What is claimed is:

1. An image fixing device comprising:

a fixing roller;

a drive gear provided on one ed off said fixing roller;

a first bearing rotatably supporting a first end of said fixing roller adjacent said drive gear;

a second bearing rotatably supporting a second end of said fixing roller opposite to said drive gear; and a frame supporting said fixing roller through bearings;

said fixing roller being adapted to be inserted into said fame by being moved in a direction perpendicular to the axis hereof;

said first bearing holding the entire circumference of said first end of said fixing roller, while said second bearing supports only part of the circumference of said second end of said fixing roller.

2. An image fixing device according to claim 1, wherein said second bearing supports about half the circumference of said fixing roller.

3. An image fixing device according to claim 1, wherein said first bearing and said second bearing are slide bearings which slidably support said fixing roller.

4. An image fixing device according to claim 1, wherein said frame is made of a plastic.

5. A image fixing device according to claim 1, wherein said second bearing is opened at a portion thereof to enable said second end of said fixing roller to be inserted into said second bearing by the movement in said direction of insertion.

6. An image fixing device according to claim 1, wherein said fixing roller is provided with a heat source therein.

7. An image fixing device according to claim 1, wherein said device further has a pressure roller disposed in said frame and held in pressure contact with said fixing roller.

8. An image fixing device according to claim 7, wherein a direction of insertability of said fixing roller is substantially the same as a direction of pressure of contact between said pressure roller and said fixing roller.

9. An image fixing device according to claim 1, wherein a direction of insertability of said fixing roller is substantially the same as a direction of pressure angle of the pressure acting on said drive gear.

10. An image fixing device according to claim 1, wherein said frame is provided with a support portion for receiving an external force which is exerted on said fixing roller as a result of driving of said fixing roller by said drive gear.

11. An image fixing device according to claim 1, further comprising a pressure roller held in pressure contact with said fixing roller, said second bearing being opened at a portion thereof adjacent said pressure roller.

12. An image fixing device comprising:

a heating roller provided with a heat source therein;

a frame provided with bearings for supporting said heating roller through the bearings in an elongated space within said frame said frame being fixed in relation to said heating roller while said heating roller is supported therein;

an abnormal temperature rise prevention element capable of shutting off the supply of electrical power to said heat source in the event of an abnormal temperature rise on a surface of said heating roller, said element being mounted on said frame at a position laterally beside the elongated space in which said heating roller is supported, wherein said heating roller is insertable into the space in said frame in a direction perpendicular to an axis of said heating roller, and said abnormal temperature rise prevention element is located on said frame on a side of the space for said heating roller opposite to the side of the direction from which the heating roller is inserted, thereby avoiding damage to the heating roller from contact with said element during insertion of the heating roller into the space.

13. An image fixing device according to claim 12, wherein said abnormal temperature rise prevention element includes a thermo-switch.

14. An image fixing device according to claim 12, wherein said frame is made of an electrically insulating material.

15. An image fixing device according to claim 14, wherein said frame is molded from a plastic.

16. An image fixing device according to claim 12, further comprising a backup roller received in said frame aid making a pressure contact with said heating roller.

17. An image fixing device according to claim 16, wherein a direction of insertion of said heating roller is substantially the same as a direction of a pressure of contact between said backup roller and said heating roller.

18. An image fixing device according to claim 12, wherein said heating roller is provided at its one end with a drive gear, the direction of insertion of said heating roller being substantially the same as a direction of a pressure angle of a pressure acting on said drive gear.

19. An image fixing device according to claim 12, wherein said heating roller is provided at one end thereof with a drive gear, said frame being provided with a support portion for receiving a external force which acts on said heating roller as a result of driving of said heating roller by said drive gear.

20. An image fixing device comprising:

a driving roller having on an end a driving gear for receiving a drive force;

a bearing rotatably supporting said driving roller;

a frame circumferentially supporting part of said bearing;

a backup member that in combination with said driving roller forms a nip for gripping conveying a recording material; and a drive transmission gear meshing with said driving gear and transmitting a driving force to said driving gear, wherein said driving gear and said drive transmission gear are provided so that an external force generated by driving the driving gear by the drive transmission gear is directed from a meshing portion of the driving gear and the drive transmission gear toward the inside of the area where the frame supports the bearing.

21. An image fixing device according to claim 20, wherein said frame supports said backup member.

22. An image fixing device according to claim 20, wherein said frame includes means for allowing said driving roller to be inserted and a direction of pressing by said pressing means is substantially the same as a direction of inserting of said driving roller into said frame.

23. An image fixing device according to claim 20, wherein said frame includes means for allowing said driving roller to be inserted and the direction of inserting said driving roller into said frame is substantially the same as a direction of pressure angle of pressure acting on said driving gear.

24. An image fixing device according to claim 20, further comprising a supporting member which supports said backup member through bearings, and wherein said driving roller is supported by said frame through bearings and said supporting member is fixed to a predetermined portion of said frame so that said backup member is automatically set in said frame.

25. An image fixing device according to claim 24, wherein said backup member is brought into pressure contact with said driving roller within said frame by the fixing of said supporting member to said predetermined portion of said frame.

26. An image fixing device according to claim 24, wherein said supporting member is adapted to receive said backup member for mounting in a direction perpendicular to the axis of said backup member.

27. An image fixing device according to claim 24, wherein said frame has a pivot support for pivotally supporting said support member, a position of said pivot support determinating a direction of insertion of said backup member.

28. An image fixing device according to claim 20, wherein at least one of the bearings supporting said driving roller, which is opposite to said drive gear, has an upwardly opening arcuate form.

29. An image fixing device according to claim 20, further comprising a heater provided in said driving roller, and a temperature sensing element provided on said frame for sensing the temperature of the surface of said driving roller.

30. An image fixing device according to claim 20, wherein said frame is molded from an electrically insulating plastic.

31. An image fixing device according to claim 20, wherein said frame is provided with a guide for guiding the movement of said recording member.

32. An image fixing device according to claim 20, further comprising a second frame for supporting said backup member.

* * * * *

UNITED STATES PATENT AND TRADEMARK OFFICE

CERTIFICATE OF CORRECTION

PATENT NO. : 5,481,347

DATED : January 2, 1996

INVENTOR(S) : NOBUKAZU ADACHI, ET AL.

It is certified that error appears in the above-indentified patent and that said Letters Patent is hereby corrected as shown below:

Column 1,
line 43, "tile" should read --the--.
Column 2,
line 20, "a" should read --an--; and
line 52, "he" should read --the--.
Column 3,
line 8, "front" should read --from--;
line 33, "be" should read --the--;
line 48, "ear 10" should read --gear 10--; and
line 49, "tat" should read --that--.
Column 4,
line 25, "proces" should read --process--.
Column 5,
line 28, "he" should read --the--;
line 36, "ed off" should read --end of--; and
line 43, "fame" should read --frame--.
Column 6,
line 21, "frame" (first occurrence) should read --frame,--;
line 51, "aid" should read --and--; and
line 65, "a" should read --an--.
Column 7,
line 27, "the" should read --a--.

UNITED STATES PATENT AND TRADEMARK OFFICE

CERTIFICATE OF CORRECTION

PATENT NO. : 5,481,347

DATED : January 2, 1996

INVENTOR(S) : NOBUKAZU ADACHI, ET AL.

It is certified that error appears in the above-indentified patent and that said Letters Patent is hereby corrected as shown below:

Column 6,
line 21, "frame" (first occurrence) should read --frame,--;
line 51, "aid" should read --and--; and
line 65, "a" should read --an--.

Column 7,
line 27, "the" should read --a--.

Signed and Sealed this

Twenty-eighth Day of May, 1996

Bruce Lehman

*Attest:*

BRUCE LEHMAN

*Attesting Officer*

*Commissioner of Patents and Trademarks*